United States Patent [19]

Cobble

[11] Patent Number: 4,712,251

[45] Date of Patent: Dec. 15, 1987

[54] NURSING BLANKET

[76] Inventor: Danna J. Cobble, P.O. Box 7294, Oklahoma City, Okla. 73153

[21] Appl. No.: 928,919

[22] Filed: Nov. 10, 1986

[51] Int. Cl.[4] ..... A41D 13/10; A41D 1/20

[52] U.S. Cl. ..... 2/49 R; 2/104

[58] Field of Search ..... 2/104, 49 R, 48, 50, 2/51, 174

[56] References Cited

U.S. PATENT DOCUMENTS

| | | | |
|---|---|---|---|
| 1,206,480 | 11/1916 | Stagg | 2/104 |
| 2,417,888 | 3/1947 | Schuster | 2/104 |
| 4,133,052 | 1/1979 | Hodgman et al. | 2/174 |
| 4,468,816 | 9/1984 | Kaufer | 2/104 |
| 4,567,611 | 2/1986 | Kendrick | 2/104 |
| 4,601,068 | 7/1986 | Frechette | 2/104 |
| 4,605,017 | 8/1986 | Thompson et al. | 2/174 |

*Primary Examiner*—Doris L. Troutman
*Attorney, Agent, or Firm*—Robert K. Rhea

[57] ABSTRACT

A nursing mother's garment comprised of a shoulder apparatus known as a shoulder bib and an attachable blanket-type draping known hereafter as a blanket, which provides concealment of the wearer's upper body and the baby's head and upper body, while providing maximum fresh air flow to the baby and viewing of the nursing process by the mother only. For nursing, the shoulder bib is placed on the wearer's shoulder with the blanket attached to it by a plurality of fasteners. The blanket attaches to the lower edge of the front portion of the shoulder bib and extends from directly above the wearer's breast downwardly past the wearer's waistline and laterally from beyond the wearer's arm nearest the shoulder bib across the wearer's breast beyond her mid-chest. The blanket forms a lightweight, loose-fitting, drape across the wearer's front torso which permits a child to nurse in complete comfort, while concealing the mother's breast.

1 Claim, 7 Drawing Figures

NURSING BLANKET

BACKGROUND—FIELD OF INVENTION

It is the object of this invention to provide an improved nursing garment in the form of a shoulder apparatus, hereafter known as a shoulder bib, and an attachable blanket-type drape, hereafter known as a blanket, to be placed over the nursing mother's shoulder which provides concealment of the mother's front torso and the child's head and upper body, while providing maximum fresh air flow to the baby and allowing viewing of the nursing process by the mother. At the same time, the garment is easily put in place by the mother and easily transferred to the opposite shoulder without need of standing or placing the baby elsewhere, to provide nursing from the other breast. The garment does not cause undue hardship on the baby as to interrupt the nursing process, as most babies will not nurse properly if they are cramped or are having problems breathing. This can result in a baby not getting enough nourishment and a possible upset stomach as well as congested nose.

The garment does not interfere with the attire of the mother, as it is an article that is worn only when feeding the baby. The garment provides the mother with a view of her baby while it nurses, which aids her in guiding the child to begin nursing, replacing the baby on the breast when it slips off, and being certain of the baby's comfort while nursing. This view also aids the mother to see to fasten and unfasten her nursing attire and gives her coverage while preparing her clothing to enable her to nurse and while replacing her clothing in its non-nursing state.

BACKGROUND—DESCRIPTION OF PRIOR ART

Heretofore, garments designed for the nursing mother to discreetly feed her baby have not taken into consideration the comfort of the baby, nor the need for the mother to view her baby while it nurses.

My invention is much improved over and embodies functions not previously addressed in the various attempts that have been made to accomplish the same goal, such as vests, drapes with loops, blouses with slits in the front, and so forth. Instead, my invention aims at providing a versatile garment which entirely conceals the wearer's breast and baby's head and torso, at the same time allowing baby total comfort as if it were not covered and giving the mother a full view of the nursing baby.

Earlier garments invented to conceal mother and/or child have not provided a means of maximum air flow to the baby, nor have they made it possible for the mother to see what she is doing when initially placing and replacing the baby on the breast to suckle. Further, most earlier inventions have not allowed the mother coverage while preparing her clothing to begin the nursing process, or placing them back in order when the process is completed.

Some garments are designed as articles of clothing to be worn in the place of conventional clothing. While this may sound ideal, the majority of women cannot afford nor do they desire to purchase a nursing wardrobe. These garments also fall short of providing comfort to the baby. Air flow is usually quite limited, as well as the space in which to place the baby.

Other garments invented to be worn over the conventional dress often times do not blend with current fashions, must be used with a certain style of garment only, and can be complicated, thus limiting their use. These also do not take into consideration the comfort of the child.

Garments invented to be used only while nursing the baby and serve no other purpose create extra bulk to be carried by the mother along with her personal belongings and those needed by the baby. They, too, limit the amount of fresh air circulating to the baby.

In spite of previous inventions many, if not most, nursing mothers today use the method of throwing a receiving blanket over the baby's head and shoulders and placing a corner of the blanket across her own shoulder in order to nurse discreetly. The material used in most receiving blankets causes the baby to become too warm; the fresh air flow is cut off, making it stuffy and hard for the baby to breathe; and the mother's view is totally blocked thus she cannot see to guide her baby to nurse.

None of the previous inventions allow maximum air circulation to the baby and enable the mother to view the nursing child, while providing maximum coverage of the mother's breast and the baby's head and upper body.

It is the object of this invention to meet all of these needs of the nursing mother and child.

OBJECTS AND ADVANTAGES

The principal objects and advantages of the invention are: to provide adequate coverage of the nursing mother's upper body and the baby's head and torso, at the same time taking into consideration the child's comfort; to provide maximum air circulation to the nursing child from either or both sides of the blanket draping, as well as from the upper edge of the blanket; to provide the nursing mother with a full view of her baby's face and her own breast while no one else may see; to provide as cool or warm an environment as possible, depending on the season, for the baby; to provide the nursing mother a simple, yet efficient, method of discreetly nursing her baby; to provide room for the baby to stretch or cuddle, whichever position he prefers, while still remaining covered; to provide a garment that can be used with any aged nursing baby or child; to provide a garment that will conceal a woman of any size when nursing her baby; to provide a garment that transfers easily from one shoulder to the other, preferably using one hand and without having to stand, when moving the baby to suckle the remaining breast; to provide a garment that conceals the wearer as she prepares her own clothing to begin nursing and as she replaces her clothing in their non-nursing state; to provide a garment that folds compactly for ease in carrying when not in use; to provide a garment that will aid in decreasing the expense of the nursing mother because it can be used with any and all pieces of a wardrobe as well as serve a variety of purposes; and to provide a concealing blanket that will stay securely in place while wearer is nursing her baby.

SUMMARY OF THE INVENTION

The bib means includes a front portion preferably triangular-shaped, and a back portion preferably rectangular-shaped. The front portion is preferably cut to fit around the upper half of the wearer's breast, and the back portion is sized to hold the weight of the attached blanket. The front and back portions are joined at the wearer's shoulder. The front portion extends laterally from the wearer's arm closest to the shoulder bib, across the wearer's chest and centered directly above the breast to be suckled. The front portion extends downwardly from the wearer's shoulder the distance to the upper region of the wearer's breast.

The back portion of the shoulder bib preferably extends downwardly from the wearer's shoulder toward a lower edge near the wearer's mid-back, and laterally from the wearer's arm closest to the shoulder bib, toward the wearer's spine.

The blanket is attached to the shoulder bib by Velcro strips or any other suitable fasteners, such as hooks and eyes, snaps, or buttons, preferably in three places. It is attached to the outer lower front portion of the shoulder bib, thus concealing from view the breast to be suckled. The blanket extends laterally from the wearer's side closest to the shoulder bib, and across the wearer's chest a distance to sufficiently cover the wearer's breast and the baby's head and upper body. The base of the blanket extends laterally beyond the wearer's side nearest the shoulder bib, across to at least the wearer's mid-torso but preferably not beyond the wearer's opposite side. The blanket extends downwardly from above the breast where it is attached to the shoulder bib, a distance to cover the infant's head and upper body, preferably past the wearer's waist, but preferably not beyond the wearer's pelvic area.

To use in its primary function, the shoulder bib is placed over the mother's shoulder with the front portion placed on her chest and the back portion placed on her back. The front portion of the shoulder bib will fit any woman when placed across her upper breast, and adjusting it to fit her own body contour. The back portion of the bib, because of its size and weight, keeps the shoulder bib and blanket securely in place.

The blanket is attached to the front of the bib with a plurality of fasteners of which Velcro is an example. It is attached preferably at three places. The shoulder bib and blanket will fit either shoulder and is moved easily from one shoulder to the other, without detaching the blanket.

To allow the wearer to view the nursing of the baby, the blanket and shoulder bib are detached from each other at the uppermost Velcro strip. The blanket can thus be pulled away from the shoulder bib at its upper edge and will remain open, while it continues to be held in place on the shoulder bib at the outer fasteners. This opening is directly above the breast and therefore the face of the nursing child, giving the mother a view of the process.

To allow maximum air circulation, the blanket may be pulled away from the mother's body on either or both outer sides as much as needed, while it continues to conceal the breast of the wearer and the baby's face and upper body from others.

Readers will find further objects and advantages of the invention from a consideration of the ensuing description and the accompanying drawings.

BRIEF DESCRIPTION OF THE DRAWING FIGURES

The invention can best be understood by reference to the drawings accompanying this specification in which.

DRAWING REFERENCE NUMERALS

Figure 1:
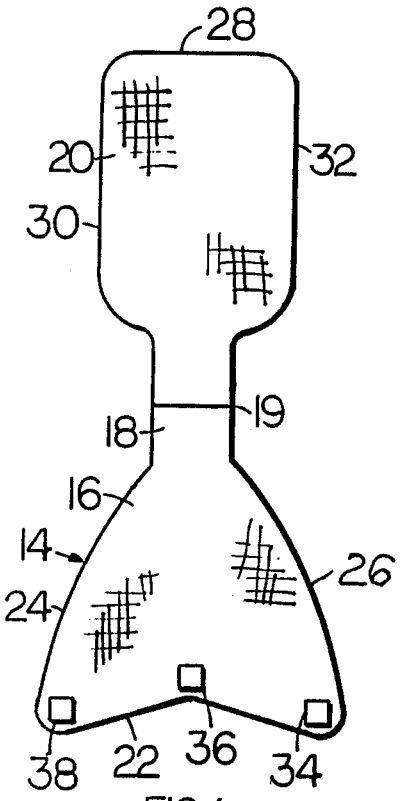
FIG. 1 is a top plan view of the shoulder bib.
Figure 2:
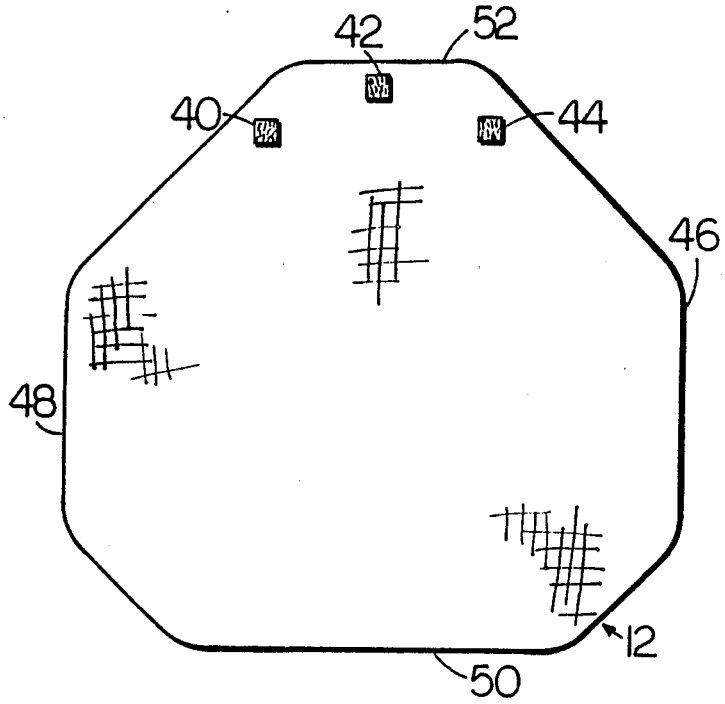
FIG. 2 is a bottom plan view of the blanket.

12: blanket
14: shoulder bib
16: front portion of shoulder bib
18: front-to-back connector of shoulder bib
19: possible seam to connect front portion to back portion of shoulder bib
20: back portion of shoulder bib
22: lower edge of front portion of shoulder bib
24: outer edge of front portion of shoulder bib
26: opposite of 24, outer edge of front portion of shoulder bib
28: lower edge of back portion of shoulder bib
30: outer edge of back portion of shoulder bib
32: opposite of 30, outer edge of back portion of shoulder bib
34: outer fastener on shoulder bib, shown as a Velcro hooked strip
36: center fastener on shoulder bib, shown as a Velcro hooked strip
38: outer fastener on shoulder bib, shown as a Velcro hooked strip, opposite of 34
40: outer fastener on blanket, shown as a Velcro looped strip
42: center fastener on blanket, shown as a Velcro looped strip
44: outer fastener on blanket, shown as a Velcro looped strip, opposite of 40
46: side edge of blanket
48: side edge of blanket, opposite of 46
50: lower edge of blanket
52: top edge of blanket

DESCRIPTION OF INVENTION

The invention can be carried out in various ways and the drawings are intended only in the way of example, and as illustrating the principle of the device.

The preferred embodiment of the invention is the blanket, generally designated 12, and a shoulder bib, generally designated 14.

Figure 3:
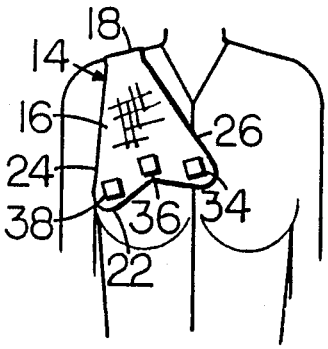
FIG. 3 is a front elevation view of the shoulder bib when placed in position for nursing.
Figure 4:
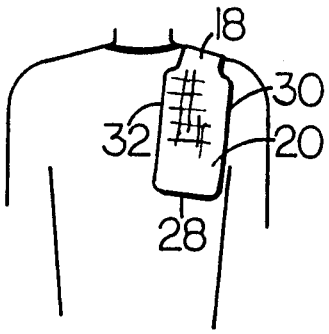
FIG. 4 is a back elevation view of the shoulder bib when placed in position for nursing.

The shoulder bib 14 includes a front portion 16, preferably triangular-shaped, a front-to-back connector 18, and a back portion 20, preferably rectangular-shaped. As illustrated in FIGS. 3 and 4, the front-to-back connector 18 is placed on the wearer's shoulder, seating the front portion 16 on the wearer's chest, centered over, but not covering one breast, and seating the back portion 20 on the wearer's back. Because the garment is uniform, it can be worn on either the left shoulder or the right shoulder, and can easily be transferred from one shoulder to the other using one hand while leaving the blanket 12 attached to the shoulder bib 14. All descriptions herein describe the shoulder bib 14 as being placed on the wearer's right shoulder.

The front-to-back connector 18 of the shoulder bib 14 can join the front portion 16 to the back portion 20 with a seam 19, but preferably not, thus making the shoulder bib 14 one continuous piece of material from the lower edge 22 of the front portion 16 to the lower edge 28 of the back portion 20.

Figure 5:
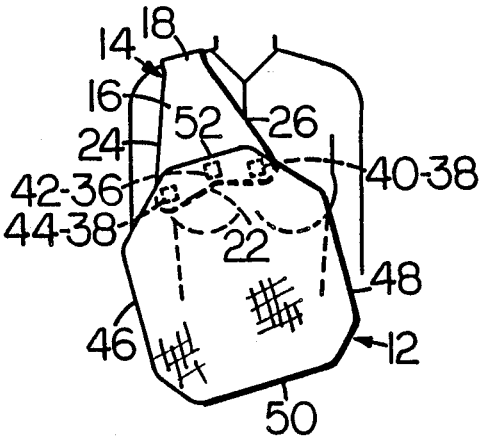
FIG. 5 is a front elevational view of the shoulder bib and the blanket when fastened together in the nursing position.
Figure 7:
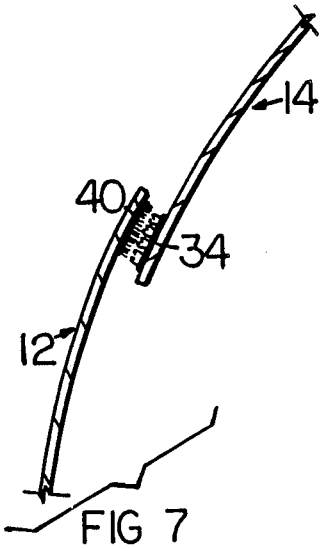
FIG. 7 is an exploded cross-sectional view illustrating the blanket to bib fastened to the shoulder bib as in FIG. 5 and FIG. 6 when using fasteners.

The blanket 12 is attached to the shoulder bib 14 by fabric strips having separable self adhering means thereon, herein referred to as "hooked strips" and "looped strips", presently marketed under the trademark Velcro or any suitable fastener. A cross-section of the fasteners is shown in FIG. 7. FIG. 5 best illustrates the fastening of the blanket 12 to the shoulder bib 14. Velcro looped strip 40 of the blanket 12, matches hooked strip 34 of the shoulder bib 14.

Figure 6:
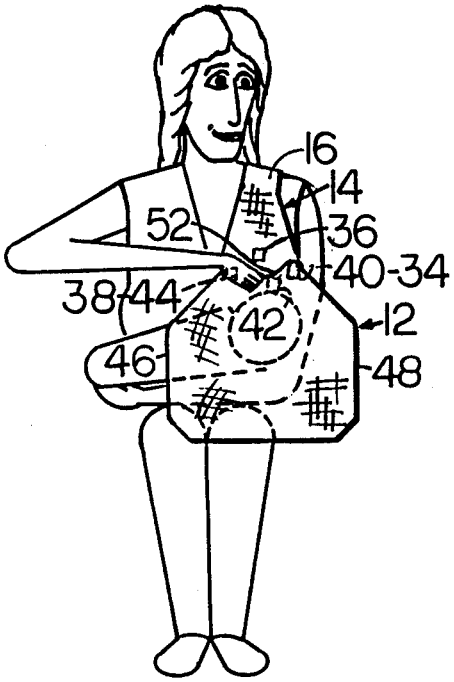
FIG. 6 is a perspective view of the shoulder bib and blanket in the nursing position when worn by a mother during nursing.

Looped strip 42 on the blanket 12, matches hooked strip 36 on the shoulder bib 14. Looped strip 44 on the blanket 12, matches hooked strip 38 on the shoulder bib 14. As shown in FIG. 6, the mother is able to view her nursing baby and remain discreetly covered, by unfastening looped strip 42 from hooked strip 36. Fresh air is able to flow to the baby from side 46 of the blanket 12, from side 48 of the blanket 12, as well as from the top edge 52 of the blanket 12, when the looped strip 42 and hooked strip 36 are unfastened from one another.

When the garment is in use as illustrated in FIG. 6, the blanket 12 is attached to the shoulder bib 14 by their fastening means. 40 on the blanket 12 is joined to 34 on the shoulder bib 14; 44 on the blanket 12 is joined to 38 on the shoulder bib 14; and if the mother does not choose to view the baby's nursing, 42 on the blanket 12 is joined to 36 on the shoulder bib 14, as illustrated in FIG. 5.

The front portion lateral edges 24 and 26 of the shoulder bib 14 extends downwardly from the wearer's shoulder at the front-to-back connector 18, preferably at oblique angles with respect to the adjacent side edge of the connector 18 with its forward or lower edge 22 terminating just above the wearer's breast. Lower edge 22 is shaped preferably in a bell curve to fit the contour of a woman's breast. The front portion 16 of the shoulder bib 14 extends laterally at its widest point from its outer edge 24 which lays over the wearer's arm closest to the shoulder bib, across the wearer's chest to the opposite outer edge 26, being centered directly above the wearer's breast closest to the shoulder bib 14. It is the bell curved shape of the lower edge 22 that aids the wearer to view the nursing child when the fasteners are detached at point 42 on the blanket 12 and point 36 on the shoulder bib 14.

The transverse width of the back portion 20 of the shoulder bib 14 is substantially greater than the transverse width of the connector 18 and longitudinally extends from the wearer's shoulder at the front-to-back connector 18, downwardly to the lower edge 28, which falls near the wearer's mid-back. The back portion 20 of the shoulder bib 14 extends laterally from the outer edge 30 which lays close to the wearer's arm nearest the shoulder bib 14, across to the opposite edge 32 which falls near the wearer's spine.

When attached to the shoulder bib 14 by a fastening means, the blanket 12 extends from its upper edge 52 which falls just above the wearer's breast, downwardly preferably at an oblique included angle along each side to its lower edge 50 which falls just past the waistline of the wearer, but preferably not beyond the wearer's pelvic area when standing. The blanket 12 extends laterally at its widest point from its outer edge 46, which falls beyond the wearer's side nearest the shoulder bib 14, across to the opposite edge 48 which falls at least to wearer's mid-chest but preferably not beyond the wearer's opposite arm.

OPERATION OF INVENTION

When used to discreetly nurse a baby, the shoulder bib 14 is placed on the wearer's shoulder as in FIG. 3, with the front-to-back connector 18 on the wearer's shoulder between the lower neck and upper arm. The front portion 16 is positioned on either side of the wearer's chest, just above the breast (FIG. 3). The fasteners, 34, 36, and 38 are on the outer side of the front portion 16.

To allow the wearer to view the baby as it nurses uppermost fastener 42 is detached from fastener 36. The upper edge 52 of the blanket 12 can thus be pulled out and away from the shoulder bib 14 and remain open, while the blanket 12 continues to be held in place on the shoulder bib 14 at the outer fasteners.

To allow maximum air flow to the baby, the blanket 12 is opened as much as needed, while continuing to conceal the breast of the wearer and the face of the baby from exposure, on either or both of the outer side edges, 46 and 48.

It seems obvious that the new garment for nursing provides totally discreet nursing, yet allows the baby to nurse in complete comfort, to receive a continuing supply of fresh air, and allows the wearer to view the nursing child. The garment can be used by persons of any size and with babies or nursing children of any age or size.

While my above description contains many specificities, these should not be construed as limitations on the scope of the invention, but rather an exemplification of one preferred embodiment thereof. Those skilled in the art will envision many other possible variations within its scope. For example, skilled artisans will readily be able to change the dimensions and shapes of the various embodiments. They will also be able to make the invention out of various types of blends of fabrics and various shades of colors and designs. They can make variations on the materials used to trim the outer edges of the shoulder bib and the blanket. They can make the shoulder bib and the blanket out of one continuous piece of material, rather than two separate pieces. They can vary the shape of the shoulder bib and the blanket without changing its primary function.

The blanket means has many unobvious uses. For example, when detached, the blanket may serve as a wrap for the child, rather than carrying a separate conventional blanket. The fasteners on the blanket will not interfere with it being used in this way. The shoulder bib folds so compactly that it may be placed in the mother's pocket or purse.

The blanket means may also serve as a changing pad, when the mother needs an article on which to place her baby to change its diaper.

The garment is serviceable to a non-nursing mother when placed on her shoulder and over her baby's head and upper body if she wishes to feed her baby by making its surroundings more peaceful and quiet, thus shutting out distractions to the baby.

The garment serves both nursing and non-nursing mothers when used as a covering of the mother's upper body and the baby's head and upper body to provide a more quiet, yet still comfortable, setting for the baby in which to sleep in its mother's arms.

These optional uses decrease the amount of articles that have to be carried by the mother when taking her child away from home, and the shoulder bib and blanket fold compactly to take up little space in the diaper bag.

What is claimed is:

1. A nursing garment for concealing the mother's breast and child's head and upper torso, comprising:

an elongated fabric bib means characterized by longitudinally extending front and back end portions of substantially equal mass respectively overlying the right or left upper chest and back area of the user and being integrally interconnected in longitudinally aligned relation by a shoulder overlying portion having a transverse width substantially less than the transverse width of the front and back portions for normally maintaining the bib means balanced on a user's shoulder, said front portion having a depending end surface substantially defining an arcuate concave curve between its lateral limits at least partially complemental with the curve of the upper limit of a user's breast;

fabric sheet blanket means depending from said bib means and characterized by opposing marginal side edges converging upwardly toward an upwardly disposed end edge of substantially equal dimension with respect to and overlying the lowermost end portion of the bib front portion; and, a plurality of spaced-apart pairs of fasteners separably joining, in overlying relation, the respective ends and medial portion of the upper end edge portion of said blanket means to the depending end portion of said bib front portion for normally concealing the user's breast and a nursing child, whereby the medial portion of the blanket upper end edge may be separated from the bib front portion for air circulation and user viewing the nursing child.

* * * * *